United States Patent [19]

Dilyard

[11] Patent Number: 4,629,846

[45] Date of Patent: Dec. 16, 1986

[54] SWITCH ASSEMBLY FOR MICROWAVE OVEN TURNTABLE

[75] Inventor: Richard D. Dilyard, Wooster, Ohio

[73] Assignee: Rubbermaid Incorporated, Wooster, Ohio

[21] Appl. No.: 785,921

[22] Filed: Oct. 9, 1985

[51] Int. Cl.[4] ..... H05B 6/78

[52] U.S. Cl. ..... 219/10.55 F; 219/10.55 E; 108/20; 108/142

[58] Field of Search ..... 219/10.55 E, 10.55 F, 219/10.55 R; 99/448, 423, 443 R; 126/338 R; 108/20, 139, 142

[56] References Cited

U.S. PATENT DOCUMENTS

| | | | |
|---|---|---|---|
| 4,216,727 | 8/1980 | Cunningham | 108/20 |
| 4,239,009 | 12/1980 | Cunningham | 108/20 |
| 4,254,319 | 3/1981 | Beh et al. | 219/10.55 E X |
| 4,258,630 | 3/1981 | Jorgensen et al. | 108/20 |
| 4,308,445 | 12/1981 | Offutt | 219/10.55 F |
| 4,330,696 | 5/1982 | Pomeroy et al. | 219/10.55 E X |
| 4,330,697 | 5/1982 | Danley et al. | 219/10.55 F |
| 4,434,343 | 2/1984 | Bowen et al. | 219/10.55 F |
| 4,456,805 | 6/1984 | Jorgensen et al. | 219/10.55 E X |
| 4,504,715 | 3/1985 | Jorgensen et al. | 219/10.55 F |
| 4,523,070 | 6/1985 | Jorgensen et al. | 219/10.55 F |

*Primary Examiner*—Philip H. Leung

*Attorney, Agent, or Firm*—Richard B. O'Planick

[57] ABSTRACT

A switch assembly for microwave oven turntable is disclosed. The turntable comprises a base (4) and a platform (6) rotatably mounted thereupon. The platform (6) is adapted having a downward pripheral rim flange (36), along which an annular gear ring (38) is provided. A flange (20) extends outward from the base beyond and below the rim flange (20). A switch mechanism includes a rocker body (48) pivotally mounted to the flange (20) and adapted to pivot toward and away from the flange (36). A locking finger (60) extends under the rim flange (36) and upward into a parallel and adjacent relationship with the gear ring (38). The locking finger (60) is of triangular saw-toothed cross section defining an apex ridge (62) oriented toward the gear ring. The gear teeth of the gear ring (38) likewise have a saw-tooth configuration. Rocking actuation of the switch body causes the locking finger (60) to pivot toward and away from meshing engagement with the gear ring (38).

10 Claims, 5 Drawing Figures

SWITCH ASSEMBLY FOR MICROWAVE OVEN TURNTABLE

BACKGROUND OF THE INVENTION

1. Field of the Invention

The subject invention relates generally to portable turntables for use in microwave ovens and specifically to switch assemblies for such turntables for controlling rotational movement.

2. The Prior Art

Portable turntables for microwave ovens are known and are commonly available in consumer markets. Such devices typically comprise a stationary base, a rotatable platform mounted to the base, and a drive motor. An on/off switching mechanism is generally provided to control the rotational movement of the platform relative to the base.

Achievement of a suitable on/off switch for microwave turntables has proven illusive. Such switching mechanicms must be convenient to operate, fail-safe, and compact in spacial dimension so as to fit within the smaller microwave oven cavities. Further, the switching mechanism must smoothly act to move the turntable in and out of its rotational mode of operation without requiring manual manipulation.

Various approaches at attaining an acceptable on/off switch for such turntables have been tried. For example, U.S. Pat. No. 4,434,343 teaches a rotatable platform component having a downward peripheral rim flange which incorporates inward directed gear teeth spaced therealong. A slidable lock is provided which extends below the downward rim flange and axially moves inward and outward whereby moving a rectangular meshing tooth in and out of engagement with the rim flange gear teeth.

While the above switch mechanism works well, it has certain deficiencies which prevent it from achieving all of the above-discussed performance requirements. First, operation of a sliding switch is cumbersome and can result in the turntable being pushed or pulled in jarring fashion. Undesired spillage of food stuffs supported by the turntable can result. Further, sliding actuation can cause the tooth of the sliding mechanism to stub against the gear teeth along the rim flange. Overcoming the impasse would require manual jogging of the lock mechanism and/or the turntable platform. However, such a procedure in the small confines of a microwave oven is awkward and can, again, result in foodstuff spillage.

SUMMARY OF THE PRESENT INVENTION

The subject invention relates to a switch assembly for a microwave oven turntable of the turntable type having a base and a platform rotatably mounted thereupon to rotate about a central axis. The rotatable platform is adapted having a downward peripheral rim flange, along which an annular gear ring is provided. The base of the turntable unit provides a switch supporting flange extending outward beyond the rotatable platform and below the dependent rim flange thereof.

According to the present invention, a switch mechanism includes a rocker body pivotally mounted to the switch support flange outward of the rim flange and aligned to selectively pivot toward and away from the turntable assembly. The rocker body is configured having an inward directed generally U-shaped locking finger extending under the rotatable platform rim flange and then upward into a parallel and adjacent relationship with the gear ring. Pivotal selective movement of the rocker body causes the remote end of the locking finger to move in and out of engagement with the gear ring.

According to a further aspect of the present invention, the remote locking portion of the switch finger is of triangular saw-toothed cross section whereby defining an apex ridge oriented toward the gear ring. Rocking actuation of the switch mechanism causes the locking finger to cleanly pivot toward and into meshing engagement with the gear ring without stubbing.

Accordingly, it is an objective of the subject invention to provide a switching mechanism for a microwave turntable which is compact in configuration.

A further objective is to provide a switching mechanism for a microwave oven turntable which is convenient to actuate.

Yet a further objective of the present invention is to provide a switching mechanism for a microwave oven turntable which reduces the likelihood of stubbing or jamming during its operation.

Yet a further objective of the subject invention is to provide a switching mechanism for a microwave oven turntable which is composed of a relatively small number of component parts.

Yet a further objective of the subject invention is to provide a switching mechanism for a microwave oven turntable which is economically and readily produced and readily assembled.

These, and other objectives which will become apparent to those skilled in the art, are achieved by a preferred embodiment which is described in detail below and which is illustrated by the accompanying drawings.

BRIEF DESCRIPTION OF THE ACCOMPANYING DRAWINGS

DETAILED DESCRIPTION OF THE PREFERRED EMBODIMENT

Figure 3:
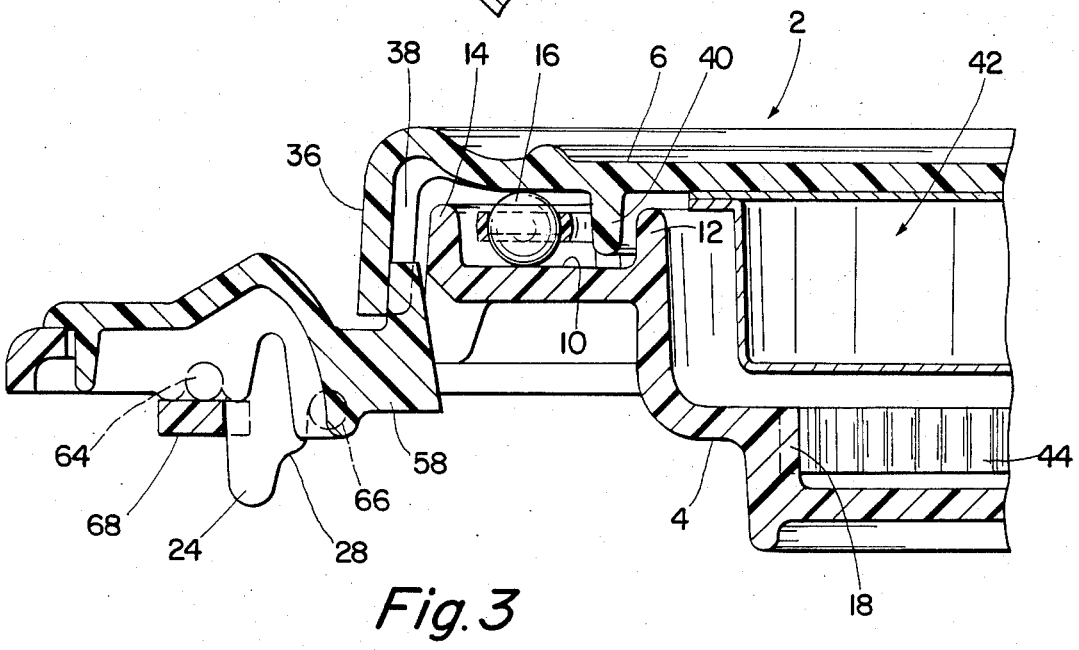
FIG. 3 is a transverse section view through the microwave oven turntable illustrating the switch in assembled and locking condition relative to the turntable rotatable platform and base.

Referring first to FIG. 3, the subject microwave turntable 2 is shown as generally comprising a base component 4 having a rotatable platform 6 mounted thereto. Components 4, 6 are generally circular in top plan view and are concentric about a central vertical axis. An annular channel 10 extends about the outward periphery of the base component 4 and is defined by an inner side wall 12 and an outer side wall 14. A bearing ring 16 resides within the channel 10. The base component 4 is further adapted having a circumferential drive gear ring 18 formed therein to reside proximate to the bottom of the base unit, with the drive gear ring 18 being concentric with the vertical axis of the microwave turntable.

Figure 1:
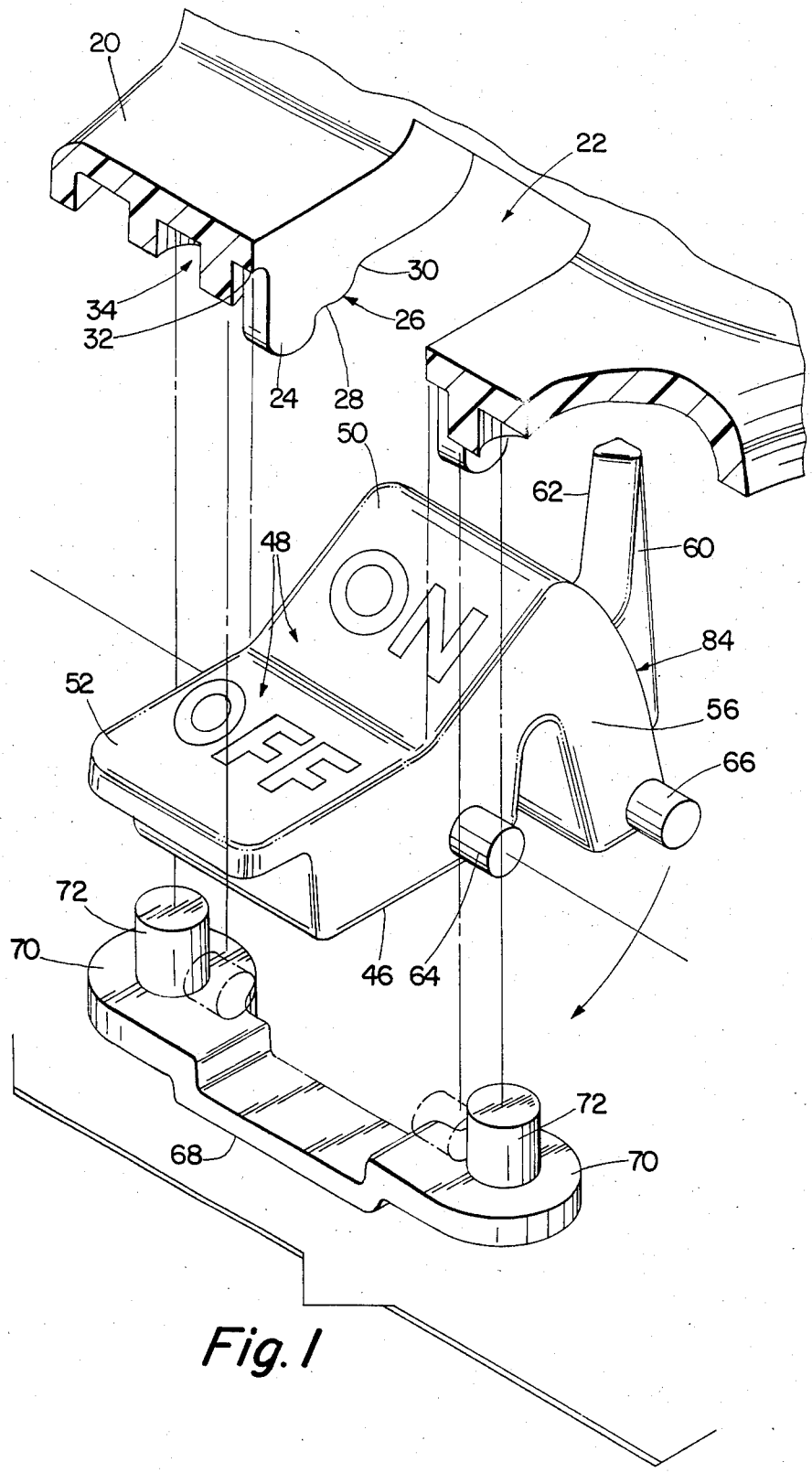
FIG. 1 is an exploded perspective view of the switching mechanism comprising the subject invention.
Figure 2:
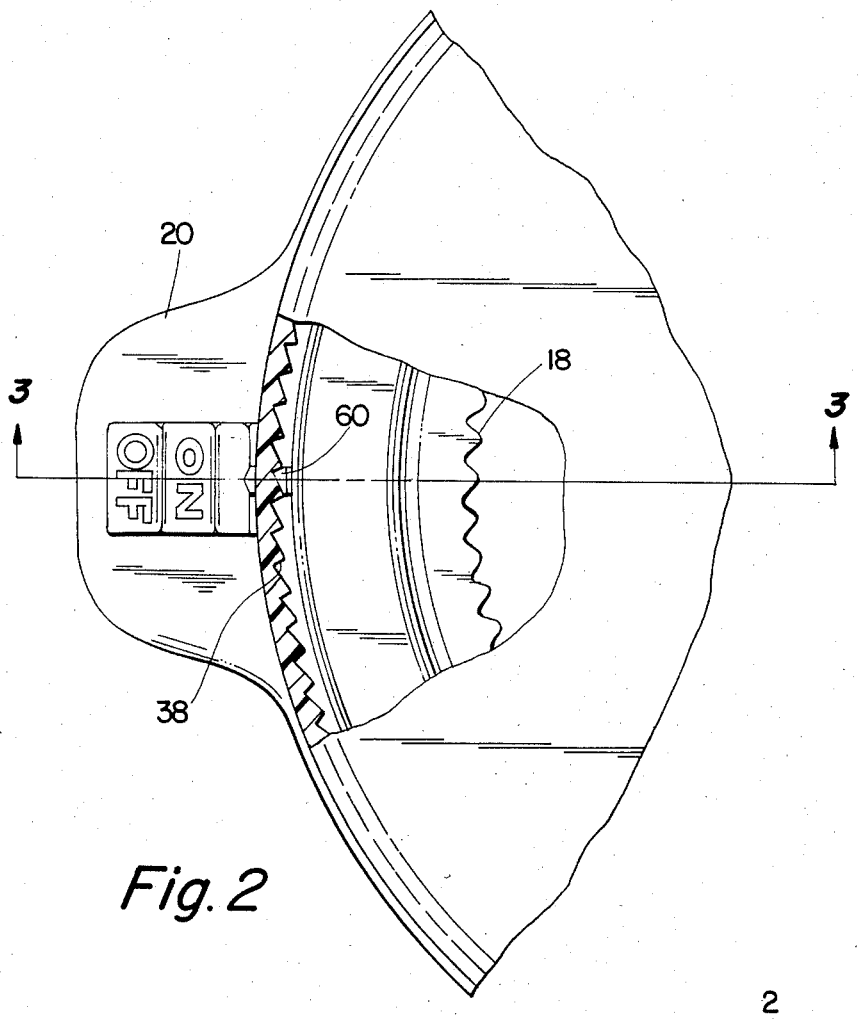
FIG. 2 is a top plan view of the microwave oven turntable assembly, sectioned away to illustrate engagement between the locking finger of the switch mechanism and the rotatable platform component.

Referring jointly to FIGS. 1 and 2, it will be seen that a switch supporting flange 20 extends outward from the base component of the microwave turntable. The switch supporting flange 20 is adapted to include a rectangular shaped slot 22 formed therethrough. The underside of the switch supporting flange 20 is profiled specifically as follows. Dependent support legs 24 extend downward from the flange 20 proximate to the outward end of the rectangular slot 22. Extending inward from the support legs 24, along the underside of the support flange 20, and parallel to longitudinal sides of the rectangular slot 22 are serpentine detent surfaces 26. The detent surfaces 26 define an "ON" detent 28 portion which is proximate to the support legs 24 and an "OFF" detent portion 30 which is inward thereof. Residing adjacent to each support leg 24 is a pivot slot 32 which extends upwardly into an underside of the support flange 20. Adjacent to each pivot slot 32 is an assembly bore 34 which likewise extends upward into an underside surface of the support flange 20.

Proceeding again to FIG. 3, it will be seen that the rotatable platform 6 of the microwave turntable has a peripheral rim flange 36 which depends therefrom. An inward facing gear ring 38 is formed within the dependent rim flange 36 to be concentric with the vertical central axis of the microwave turntable. It will be appreciated that the gear ring 38 is comprised of a series of gear teeth separated by vertical slots. Each of the gear teeth, as best viewed from FIG. 2, is adapted having a sawtooth shape for a purpose explained below.

Referencing again to FIG. 3, an inward dependent annular flange 40 extends about an underside surface of the rotatable platform 6 in parallel orientation to the dependent rim flange 36. Accordingly, the annular flange 40 and the rim flange 36 define a channel which fits over the bearing ring 16 of the microwave turntable. A motor assembly 42, of a wound spring type, is fixedly connected to an underside surface of the rotatable platform 6 and includes an external drive pinion 44 which depends therefrom to engage the annular drive gear ring 18 of the base component 4.

With continued reference to FIGS. 1 and 3, the subject switch assembly is shown to include a rocker body 46 of distinctive shape and profile. The rocker body 46 is adapted having a V-shaped top surface 48 defining an "ON" region 50 and an outward "OFF" region 52. Regions 50, 52 intersect at an angle of approximately 120°. The rocker body 46 has a generally inverted U-shaped medial profile including a downward vertical support leg 56. Extending forward from the dependent leg 56 is a U-shaped projection which includes a horizontal bight portion 58 adjoining a vertical inwardmost locking finger 60. The locking finger 60 is structured to have a generally sawtoothed triangular sectional shape whereby defining an elongate vertical ridge 62 directed outward toward the rocker body 46. The shape of the vertical locking finger 60 will be better appreciated from FIG. 2.

Continuing with reference to FIGS. 1 and 3, the rocker body 46 is adapted to provide pivot pins 64 which are directed outward from sides of the rocker body 46 generally intermediate of its length. Detent pins 66 are further provided to extend outward from sides of the downward support leg 56. The switch assembly further comprises a retention bar 68 of elongate generally rectangular shape. The elongate retention bar 68 has upwardly stepped end portions 70 from which vertical assembly posts 72 project.

Assembly of the subject switch to the turntable proceeds as follows. With reference to FIG. 1, the rocker body 46 is inserted into the rectangular slot 22 of the support flange 20. So located, the rocker body pivot pins 64 reside within the pivot slots 32 of the support flange 20. It will be appreciated that the outward detent pins 66 of the rocker body 46 are located so as to bear against the serpentine detent surfaces 26 in the underside of the support flange 20. The retention bar 68 bears against the underside of the rocker body 46 to securely retain the rocker body against the support flange 20. Assembly posts 72 of the retention bar 68 are press fit into the assembly bores 34 to complete the assembly.

Figure 5:
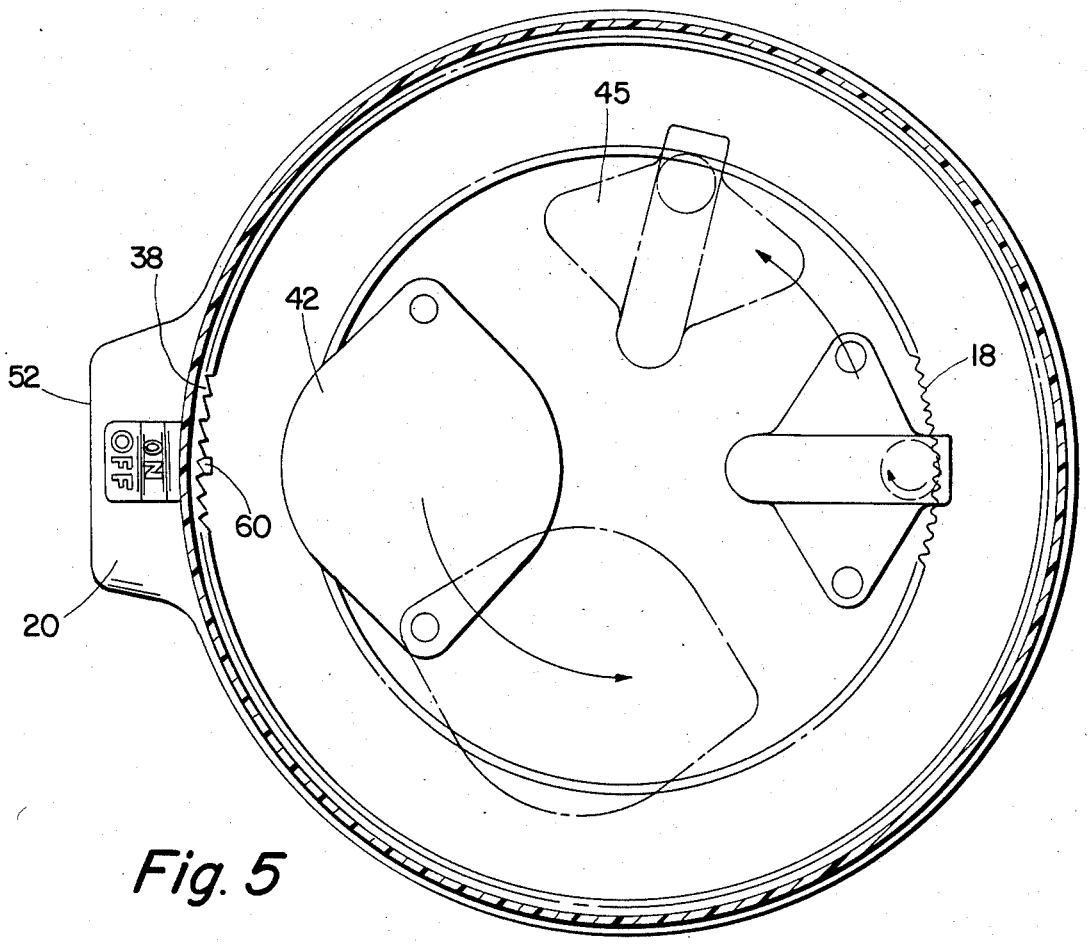
FIG. 5 is a top plan view of the subject microwave oven turntable illustrating schematically the operation of the switching mechanism comprising the subject invention.

The subject switch assembly functions as follows. As best viewed from FIG. 5, it will be appreciated that the spring motor assembly 42 is wound by manually rotating the turntable platform clockwise relative to the base. The switch assembly is generally in the OFF position during the winding phase. In FIGS. 1 and 3, it will be seen that with the rocker body 46 in the OFF position, the detent pins 66 bear against the OFF detent 30. In this position, the vertical locking finger 60 is meshed into the inward facing gear ring 38 of the table platform 6. Due to the sawtooth configuration of the gear ring teeth 38 and the vertical locking finger 62, ratcheting of the locking finger 60 occurs as the rotatable platform 6 is wound clockwise relative to the base 4.

Figure 4:
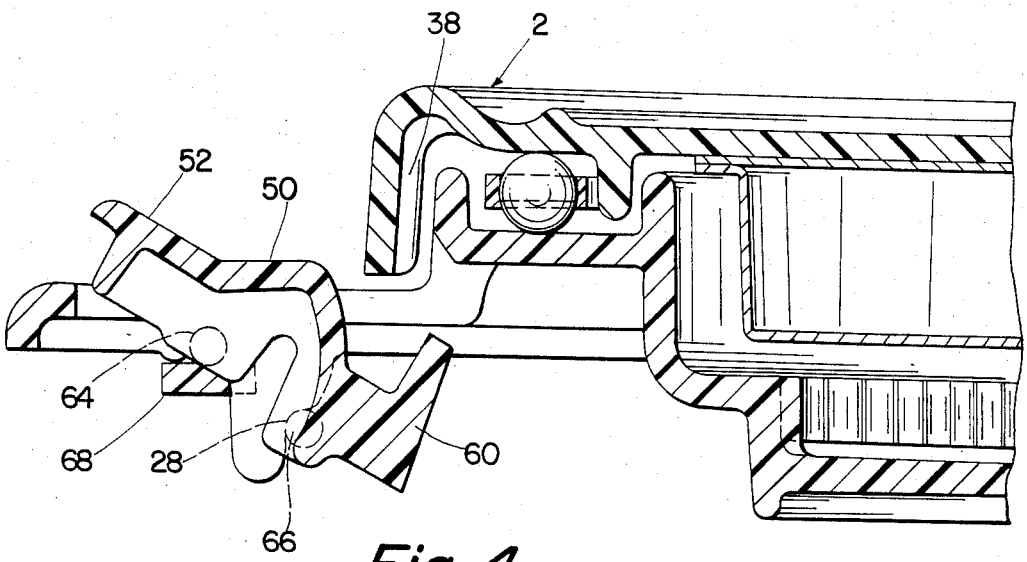
FIG. 4 is a transverse sectional view through the subject microwave oven turntable illustrating the switch in the "on" position relative to the turntable rotatable platform and base.

Subsequent to the winding operation, the switch mechanism can be disengaged by pivoting the rocking body 46 inward into the ON position. As the rocker body 46 is pivoted inwardly, the detent pins 66 ride over the serpentine detent surface 26 and into the ON detents 32. A positive tactile registration of the detent pins 66 results. As the rocker body 46 is pivoted, the vertical locking finger 60 is pivoted away from the gear ring 38. The rotatable platform 6 is thereby free to rotate in the counterclockwise direction during its operational mode. FIG. 4 illustrates the switch assembly in the ON position.

From FIGS. 1 and 2 it is seen that when rotational motion of the platform is to be terminated the switch rocker body 46 is pivoted into the OFF position. Resultingly, the detent pins 66 ride over the detent surface 26 and into the OFF detent 30. Outward pivotal rotation of the rocking body 46 causes the vertical locking finger 60 to pivot toward the gear ring 38. The sawtooth configuration of the gear teeth 38 and the locking finger 60 insure that the locking finger 60 will mesh freely without stubbing against the gear teeth. In particular, the outward directed apex ridge 62 of the vertical locking finger 60 penetrates between adjacent like-pointed gear teeth 38 without stubbing. Resultingly, the rotational movement of the rotatable turntable is terminated immediately and efficiently.

From the foregoing, it will be appreciated that the subject switching mechanism is of a component configuration which comprises a relatively few number of assembly parts. Further, the switching actuation is relatively fail-safe due to the configuration of the locking finger and the gear teeth in the rotatable platform rim. Also, the pivotal rocking actuation of the switch reduces the likelihood that the actuation movement will jar the microwave turntable itself and cause spillage. A rocking actuation additionally minimizes the stubbing which might occur between the locking finger and the annular gear ring. Finally, positive registration of the rocker body detent posts in detent slots provides the operator with a positive tactile response.

While the foregoing describes the preferred embodiment of the subject invention, the teachings herein are not to be so confined. Other embodiments, which will become apparent to one skilled in the art and which utilize the teachings herein set forth, are intended to be within the scope and spirit of the subject disclosure.

I claim:

1. A microwave oven turntable comprising a base component, a platform component rotatably mounted thereupon to rotate about a central vertical axis, and a switch assembly, said switch assembly comprising: said rotatable platform having a downward peripheral rim flange, and an annular concentric ring of gear teeth spaced along a side of said rim flange facing inward toward said central vertical axis; said base having switch support means extending outward beyond said platform and beneath said rim flange; a V-shaped rocker body pivotally mounted to said switch support means outward of said rim flange and aligned to selectively pivot toward and away from said rim flange; and said rocker body having a finger projection directed toward and extending under said platform rim flange and engaging said inward facing annular gear ring thereof; whereby said selective pivoting of said rocker body rotating said finger projection in and out of meshing engagement with said gear ring.

2. A switch assembly according to claim 1 wherein said finger projection having an elongate vertical end portion situated parallel and proximate to said gear ring.

3. A switch assembly according to claim 2 wherein said vertical end portion being of a sawtoothed triangular cross section having a leading angular edge directed outward toward said gear ring.

4. A switch assembly according to claim 1 wherein said switch support means having detent surface means therein and said rocker body having pin projection means for registering with and traveling along said detent means as said rocker body is pivoted.

5. A switch assembly according to claim 4 wherein said switch support means comprising a horizontal flange having an opening for receiving said rocker body therein and clamping means for retaining said rocker body against an underside of said flange.

6. A switch assembly according to claim 5 wherein said detent means being formed within an underside surface of said flange.

7. A microwave oven turntable comprising a base component, a platform component rotatably mounted thereto concentric about a central axis of said base, and a switch assembly comprising: said rotatable platform having a downturned rim flange enclosing a top of said base, said rim flange providing an annular gear ring extending concentrically about said base center axis, with said gear ring having vertically oriented interstitial spaces separating adjacent gear teeth;

said base having a switch supporting flange extending beyond and below said platform rim flange and having a central opening therein; a rocker body pivotally mounted to an underside of said switch supporting flange an residing within said flange opening, said rocker body being aligned to selectively pivot toward and away from said rim flange;

said rocker body having a locking finger projecting inward toward said base central axis and extending below and around said platform rim flange for engaging said annular gear ring, whereby said selective pivoting of said rocker body swinging said locking finger in and out of meshing engagement with said gear ring.

8. A switch assembly according to claim 7 wherein said rocker body locking finger having an elongate remote vertical end portion situated parallel to and proximate said gear ring for rotating into meshing engagement with said gear ring substantially parallel to said rim flange.

9. A switch assembly according to claim 8 wherein said vertical portion being of saw toothed triangular cross section having a leading angular edge oriented outward toward said gear ring.

10. A switch assembly according to claim 9 wherein said switch supporting flange having detent surface means formed in the underside thereof and said rocker body having detent projections for engaging said detent surface means.

* * * * *